United States Patent [19]

Gundlach

[11] 4,122,210

[45] Oct. 24, 1978

[54] ELECTROSTATIC POWDER IMAGE TRANSFER USING PAIR OF ELECTRODES, ONE POINTED, ONE BLUNT

[75] Inventor: Robert W. Gundlach, Victor, N.Y.

[73] Assignee: Xerox Corporation, Stamford, Conn.

[21] Appl. No.: 840,890

[22] Filed: Oct. 11, 1977

[51] Int. Cl.[2] ..... B05D 1/06

[52] U.S. Cl. ..... 427/24; 96/1.4; 355/3 TR; 118/644; 118/647

[58] Field of Search ..... 96/1.4; 118/621, 625, 118/653, 644, 647; 355/3 TR; 427/25, 14, 26, 27, 24; 209/127, 128

[56] References Cited

U.S. PATENT DOCUMENTS 3,997,688 12/1976 Gundlach ..... 427/25

*Primary Examiner*—John D. Welsh

[57] ABSTRACT

A method is provided for transferring a charged particulate image such as a xerographic image across gaps between electrodes where the electrode spacing is much greater than heretofore employed. Thus, envelopes containing bulky objects such as keys, novelties and the like, can be addressed by xerographically forming a particulate image in the conventional manner and transferring it in accordance with the invention. In accordance with the invention, a charged particulate image is deposited on a non-absorbent dielectric transfer sheet and transferred to an absorbent receiver sheet by placing the transfer sheet and receiver sheet between a pair of electrodes having a potential difference sufficient to transfer the charged particulate image, one of the electrodes being a pointed electrode positioned behind the transfer sheet having an emitting angle of between 0° and about 90° so as to provide high fields at the emitting end of said electrode and the second electrode being a blunt electrode positioned behind the receiver sheet having an emitting angle of between about 90° and 180° so as to provide low fields at the emitting surface of said electrode.

13 Claims, 1 Drawing Figure

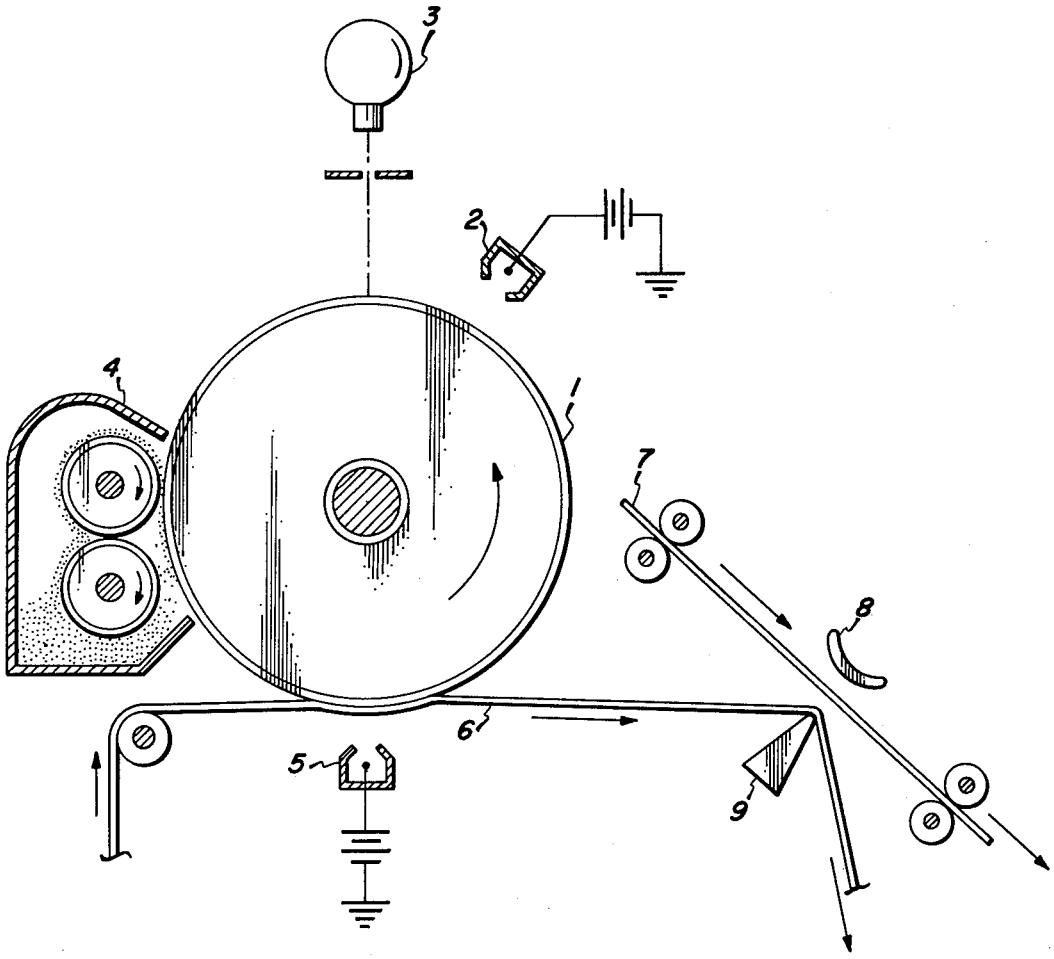
3
2
4
1
7
8
6
5
9

ELECTROSTATIC POWDER IMAGE TRANSFER USING PAIR OF ELECTRODES, ONE POINTED, ONE BLUNT

BRIEF SUMMARY OF THE INVENTION

In conventional xerography, a xerographic plate is sensitized by electrical charging, the plate exposed to form a latent electrostatic image, the latent image developed with fine particles known as toner, the developed image transferred to paper or other materials, and the image fixed by fusing. The xerographic plates are prepared by depositing a thin layer of photoconductive material on a conductive substrate. The photoconductive layer must be a good insulator in the dark to retain electrical charges on its surface. When the photoconductive material is illuminated, the electrical resistence is reduced sufficiently to permit rapid dissipation of the surface charges. The xerographic plate is sensitized by exposing the plate to corona discharge. The corona unit, energized by a high-voltage power supply, moves over the plate surface, spraying electrical charges uniformly over the photoconductive film. This operation is done in the dark so as to prevent the leaking of electrical charges away from the surface. In the sensitized condition, the plate is exposed by contact exposure or by projection. Whereever light strikes the plate, the electrical charge is conducted away from the plate surface whereas in the dark areas of the image where no light affects the plate, the electrical charges remain. Thus, after exposure, there is a latent electrostatic image of the subject on the xerographic plate.

Development of the xerographic image is accomplished by the electrical attraction of fine particles to the latent image areas on the plate. This is done most effectively when the particles carry electrical charges opposite in polarity to the latent image charges. The strength of the electrical fields produced by the latent image diminishes rapidly with distance from the plate. Thus, the developing material must be brought very close to, or into actual contact with, the plate surface. The developed image is then generally transferred to paper or other receiving surface by electrical attraction. Electrical transfer is accomplished by placing the paper in contact with the image side of the plate, charging the paper electrically with the same polarity as that of the latent image, and then removing the paper from the plate. The charge applied to the paper overcomes the attraction of the latent image for the developer particles and pulls them onto the paper. The image is then fixed such as by heat or vapor to fuse the particles to the paper.

In accordance with the invention, a means is provided whereby the strength of the electrical fields can be increased to permit transfer of the developed image where the fields must be applied across a wide gap to permit the formation of an image on stuffed envelopes containing keys and other novelties where the formation of an image by physical pressure is not feasible. Further, this transfer is accomplished at lower voltages so that less energy is required and additionally the formation of ozone is inhibited. Ozone formation, a concommitant of corona charging, can corrode equipment, is injurious to human health in high concentrations and believed to limit the sugar content in wine grapes.

In accordance with the invention, a charged particulate image such as toner, formed in the xerographic process, is transferred to a non-absorbent dielectric transfer sheet. The dielectric sheet is then placed on or in close proximity to an absorbent receiver sheet such as paper. The sheets are pulled synchronously between a pair of electrodes having a potential difference sufficient to transfer the charged particulate image to the receiver sheet. In order to enhance the charge transfer and reduce the energy required, one of the electrodes is a pointed electrode having an emitting angle of between 0° and about 90° so as to provide high fields at the emitting end of said electrode and the second electrode is a blunt electrode having an emitting angle of between 90° and 180° so as to provide low fields at the emitting surface of said electrode. Further, the image bearing dielectric should be maintained in contact with or in very close proximity to the pointed electrode.

BRIEF DESCRIPTION OF THE DRAWING

The FIGURE is a schematic illustration of xerographically forming, developing and transferring the developed image to a receiver sheet in accordance with the invention.

DETAILED DESCRIPTION OF THE DRAWING

Referring now to the FIGURE, 1 is a xerographic drum which is charged by corotron 2. At station 3 a latent image is formed by selectively exposing the plate to light and the image is developed with a xerographic toner at station 4. Corotron 5 applies a charge opposite to that of the toner so as to remove the toner image from the drum and transfer it to a non-absorbent dielectric transfer sheet 6. The transfer sheet and a receiver sheet 7 are passed between blunt electrode 8 and pointed electrode 9 which electrodes have a potential difference sufficient to transfer the charged toner image from dielectric sheet 6 to receiver sheet 7.

The pointed electrode is formed to have an emitting angle (pointed toward the receiver sheet and dielectric transfer sheet) of between 0° and about 90° so as to provide high fields at the emitting surface. For best results, the angle is preferably between about 5° and about 20° with a slight curvature at the emitting end of between about 10 and about 200 microns over which curvature the transfer sheet and/or dielectric sheet can be passed. The field strength is greater near the end of the pointed electrode and thus the sheets are passed as close as possible to it. In addition, the electrodes are preferably positioned as close as possible in order to obtain the maximum transfer efficiency. The pointed electrode however, permits the use of lower voltages such as about 4 KV as opposed to 7 or 8 KV as previously required for corona charging. The blunt electrode is a planar or gently curved conducting sheet. The pointed electrode can be a knife edge or wedge shaped conducting material.

The dielectric transfer sheet can be any relatively nonconducting self-supporting material such as Mylar, polyethylene, polypropylene, polycarbonate, and the like. Any material can be employed which will not dissipate the charge from the charged particulate material or toner. The dielectric film should have a thickness of between about 1 and 5 mils and preferably between 1 and 2 mils. Films in excess of about 5 mils cause the fields of force to be dissipated. The thickness of the receiver sheet is not critical and can be from a few mils to ½ inch or more. The receiver sheet need only fit between the electrodes.

The electrodes are maintained at a potential difference sufficient to transfer the charged particulate image which can be done in several ways. For example, a negatively charged toner can be transferred from the dielectric sheet by applying a negative potential to the pointed electrode behind said dielectric sheet and a relatively positive potential to the electrode behind the receiver sheet. Alternatively, a positively charged toner can be employed, a positive potential applied to the pointed electrode behind the insulating sheet and a relatively negative potential applied to the electrode behind the receiver sheet.

The following Example will serve to illustrate the invention.

EXAMPLE

Employing a Xerox Model D Processor and Xerox Type 10 toner, an image was formed and developed on the selenium photoconductive plate and the image electrostatically transferred to a 1 mil Mylar dielectric film. The film was then placed over an electrode forming a 90° angle and a 4 mil paper receiver sheet placed in contact with the developed image on the dielectric sheet. A grounded blunt electrode forming an angle of 180° with respect to the paper receiver sheet was placed behind the paper receiver sheet and the electrode behind the insulating sheet charged to a negative potential of about 4 KV. The negatively charged toner was transferred to the paper receiver sheet and an image of excellent contrast formed. In repeating the example, it was found that the high fields generated near the pointed electrode would transfer the toner image from the dielectric sheet to the paper receiver sheets in spite of a considerable gap of up to about ½ inch between the two electrodes. Further, better results are obtained with a pointed electrode forming an angle of between about 5° and 20° as the fields of force are greater allowing for transfer of the image using greater electrode gaps.

Having described the present invention with reference to these specific embodiments, it is to be understood that numerous variations can be made without departing from the spirit of the invention and it is intended to include such reasonable variations and equivalents within the scope.

What is claimed is:

1. A method for transferring a charged particulate image from a non-absorbent dielectric transfer sheet to an absorbent receiver sheet comprising placing said transfer sheet and receiver sheet between a pair of electrodes having a potential difference sufficient to transfer said charged particulate image from said transfer sheet to said receiver sheet, one of said electrodes being a pointed electrode positioned behind said transfer sheet having an emitting angle of between 0 degrees and about 90 degrees so as to provide high fields at the emitting surface of said electrode and a second blunt electrode positioned behind said receiver sheet having an emitting angle of between about 90° degrees and 180° degrees so as to provide low voltage gradients at the emitting surface of said electrode.

2. The method of claim 1 wherein the pointed electrode has a curvature at the emitting end of from about 10 microns to 250 microns.

3. The method of claim 1 wherein the pointed electrode has an angle of from about 5° to about 20°.

4. The method of claim 2 wherein the pointed electrode has an angle of from about 5° to about 20°.

5. The method of claim 1 wherein the receiver and transfer sheets are pulled synchronously between said electrodes.

6. The method of claim 5 wherein said sheets are pulled over the emitting end of the pointed electrode.

7. The method of claim 1 wherein the particulate image is charged negatively, the pointed electrode has a negative potential and the blunt electrode has a relatively positive potential.

8. The method of claim 1 wherein the transfer sheet is formed of Mylar of from 1 to 5 mils thickness.

9. The method of claim 1 wherein the receiver sheet is paper of from 2 mils to ½ inch.

10. The method of claim 1 wherein the particulate image is fixed to the transfer sheet by means of heat or solvent vapors.

11. The method of claim 1 wherein the particulate image is charged positively, the pointed electrode has a positive potential and the blunt electrode has a relatively negative potential.

12. The method of claim 1 wherein the gap between the electrodes is from about 3 mils to about ½ inch.

13. The method of claim 1 wherein the gap between the pointed electrode and the transfer sheet is from about 0 to ½ inch.

* * * * *